US006612091B1

(12) United States Patent
Glover et al.

(10) Patent No.: US 6,612,091 B1
(45) Date of Patent: Sep. 2, 2003

(54) ARCHITECTURAL BUILDING PANEL

(76) Inventors: Michael Glover, 44 Dufferin Road, Ottawa, Ontario (CA), K1M 2A8; Stephen Field, 745 Lonsdale Road, Ottawa, Ontario (CA), K1K 0J9

( * ) Notice: Subject to any disclaimer, the term of this patent is extended or adjusted under 35 U.S.C. 154(b) by 0 days.

(21) Appl. No.: 09/868,167

(22) PCT Filed: Dec. 16, 1998

(86) PCT No.: PCT/CA98/01181

§ 371 (c)(1),
(2), (4) Date: Jul. 24, 2001

(87) PCT Pub. No.: WO00/36260

PCT Pub. Date: Jun. 22, 2000

(51) Int. Cl.[7] ..... E04C 2/54

(52) U.S. Cl. ..... 52/786.1; 52/456; 52/311.1; 52/311.2; 52/314; 428/34

(58) Field of Search ..... 52/786.1, 783.1, 52/788.1, 741.4, 515, 784.15, 784.16, 800.14, 204.591, 314, 455, 786.11, 456, 786.13, 311.1, 311.2; 428/34, 207

(56) References Cited

U.S. PATENT DOCUMENTS

| | | | | | |
|---|---|---|---|---|---|
| 4,598,520 | A | | 7/1986 | Ellstrom | |
| 4,610,115 | A | | 9/1986 | Thompson, Jr. | |
| 4,803,817 | A | | 2/1989 | White et al. | |
| 4,819,405 | A | * | 4/1989 | Jackson | 52/171.3 |
| 4,914,877 | A | | 4/1990 | Bennett | |
| 4,968,553 | A | | 11/1990 | Cesar | |
| 5,030,503 | A | * | 7/1991 | Carter et al. | 427/162 |
| 5,059,458 | A | * | 10/1991 | Goodall | 428/212 |
| 5,228,857 | A | | 7/1993 | Roland | |
| 5,333,428 | A | * | 8/1994 | Taylor et al. | 264/254 |
| 5,465,539 | A | | 11/1995 | Rose | |
| 5,494,715 | A | | 2/1996 | Glover | |
| 5,531,047 | A | * | 7/1996 | Leopold et al. | 52/172 |
| 6,266,940 | B1 | * | 7/2001 | Reichert | 52/741.1 |
| 6,311,455 | B1 | * | 11/2001 | Gerard | 52/786.1 |
| 6,342,116 | B1 | * | 1/2002 | Balduin et al. | 156/104 |
| 6,345,485 | B1 | * | 2/2002 | Boone et al. | 52/204.61 |
| 6,362,414 | B1 | * | 3/2002 | Fujisawa et al. | 136/244 |
| 6,387,460 | B1 | * | 5/2002 | Shukuri et al. | 428/34 |
| 6,397,554 | B1 | * | 6/2002 | Kotrotsios | 52/404.1 |

FOREIGN PATENT DOCUMENTS

| | | | | |
|---|---|---|---|---|
| CA | 2071682 | | 12/1993 | |
| DE | 27 02 384 | | 7/1978 | |
| DE | 33 34 859 | | 4/1985 | |
| DE | 90 14 993 | | 3/1991 | |
| DE | 295 05 223 | | 7/1995 | |
| EP | 0667425 | * | 2/1995 | E04C/2/54 |
| EP | 0807611 | * | 5/1997 | C03C/17/34 |
| WO | 95/15267 | | 6/1995 | |
| WO | 98/43832 | | 10/1998 | |

* cited by examiner

*Primary Examiner*—Carl D. Friedman
*Assistant Examiner*—Chi Q. Nguyen
(74) *Attorney, Agent, or Firm*—Wenderoth, Lind & Ponack, L.L.P.

(57) ABSTRACT

An architectural building panel comprises a sealed glazing unit having at least two spaced apart parallel glazing sheets which define a cavity closed by a peripheral seal. Opaque strip elements on the building panel provide the appearance of window frames surrounding transparent glass areas, with regions of the panel outside these frames being provided with surface area patterns that simulate the appearance of conventional building materials such as brick or the like. The building panel can be used in any convenient size, and may be of a size to extend between structural floors of a building so that a curtain wall for the building can be composed of exteriors of such building panels.

20 Claims, 10 Drawing Sheets

FIGURE 7iii

ARCHITECTURAL BUILDING PANEL

PRIOR ART

| U.S. Pat. Nos. | | | |
|---|---|---|---|
| 4,598,520 | July 1986 | Ellstrom | 52/456 |
| 4,968,553 | November 1990 | Cesar | 428/203 |
| 5,465,539 | November 1995 | Rose | 52/204.53 |
| 5,494,715 | February 1996 | Glover | 428/34 |

INTERNATIONAL PATENTS

WO 95 15267 Stained, Glass Systems

WO 98 43832 Pearson

FIELD OF INVENTION

This invention relates generally to architectural building panels and more specifically to building panels that incorporate multiple pane sealed glazing units with decorative features.

DESCRIPTION OF THE PRIOR ART

Conventional curtain wall cladding systems are non-load bearing walls that are suspended in front of a main structural frame of a building. Typically, a curtain wall system consists of a rectangular grid of vertical and horizontal metal framing members with infill panels of clear vision glass and opaque insulating panel assemblies that can be clad with a metal, tile, stone or glass facing.

Particularly in cold weather climates, there are a number of performance drawbacks with these conventional curtain wall systems. There are four main issues:

1. Because of a metal grid framing system, there can be substantial conductive heat loss particularly through the framing system and at perimeter edges of glazing units and panel assemblies.

2. Because of a multi-component panel assembly, a jointing design for an air barrier and rain screen system can be very complex and prone to failure.

3. Particularly for elaborate heritage window designs, on-site installation can be very labor intensive.

4. Because of the need to insulate a panel wall assembly, potential rentable interior space is reduced.

In U.S. Pat. No. 5,494,715 issued to Glover, there is a description of various efforts that have been made in recent years to improve both energy efficiency and condensation resistance of multiple glazed sealed units. These improvements include: low-e coatings, argon or krypton gas fill, insulating spacing-and-desiccant systems for perimeter edge seals and narrow-width cavities (approximately ⅜" spacing for argon gas filled units).

As also noted in U.S. Pat. No. 5,494,715, there is a growing consumer interest in heritage window features and these window features can include colonial style divided-lite windows, leaded or stained glass windows and decorative sun screens. These decorative features can be very labor intensive to produce and to simplify production, Glover describes how visual illusion of these features can be created by virtue of decorative stripe patterns that are applied to two or more glazing sheets of a multiple glazed unit. Because of potential durability problems, material of the stripe patterns must be non-outgassing and with high volume production methods, experience has shown that for typical coating materials, this is a very demanding technical requirement.

Various efforts have also been made to simulate the appearance of traditional building materials. U.S. Pat. No. 4,968,553,issued to Cesar, describes how a graphic laminate is created by heat laminating a printed sheet of extruded polyurethane between two plates of glass, using a conventional autoclave process. In WO 95/15267 issued to Stained Glass Systems, an alternative method for producing decorative glass panels is described by which ceramic decals with printed designs simulating marble or other materials are applied to a glass sheet which is then heated so that ceramic material of the decals is fused to the glass sheet. In producing large decorated glass panels, a series of ceramic transfers are placed side-by-side. However, because of a need for high accuracy, this process is very labor intensive and cannot be easily automated.

In WO 98/43832, issued to Pearson, automated equipment for applying ceramic decals is described wherein heat release decals on a decal carrier are laminated onto glass sheets. Unlike an automated decal stamp pad equipment developed by Service Engineers for Stained Glass Systems, (See Product Literature: Fully Automated Multi-Color Glass Decorative Machine Designed for In-line Production, Stained Glass Systems, September 1996), decals are applied through a roller press system where glass sheets continuously pass through a laminating station.

Although large sized panels can be produced by this method, individual large scale decals are conventionally printed and their manufacturing process is not suitable for production of one-off custom products.

DE-U-295 05 223.6 discloses a building door that has an insulating glazing unit mounted in a casement frame. The glazing unit has two spaced apart parallel co-extensive glazing sheets sealed together at their peripheries. The sheets define a transparent window area that is surrounded by registering frames formed of plastic or metal and bonded to outer sides of the two sheets. An area of a door between the peripheries and the attached frames surrounding the transparent area is covered on each of the glazing sheets by a layer of opaque material which can be provided by various methods.

SUMMARY OF THE INVENTION

The invention provides an architectural building panel in the form of a sealed glazed unit comprising: at least two spaced apart parallel coextensive glazing sheets; peripheral seals extending continuously between edges of the glazing sheets to define an insulating cavity between adjacent glazing sheets. Each of the glazing sheets has a transparent area, wherein the transparent areas of respective sheets are in alignment to define a window region, and also has surface area patterns on part of at least two surfaces of the glazing sheets. Opaque strip elements are located on surfaces of two of the glazing sheets, with the opaque strip elements surrounding the transparent area of an associated one of the glazing sheets, and wherein strip elements on different surfaces are in mutually aligned registration with each other and have a width extending parallel to the glazing sheet surfaces that is sufficient to create a visual illusion of a solid member within a cavity. The combination of the transparent areas and the surface area patterns simulates the appearance of a window incorporated within a building wall.

Between a window region and peripheries of the panel, the surface area patterns on the two glazing sheets preferably comprise overlapping patterns that collectively simulate the appearance of a traditional building material, with exterior glazing sheet patterns including transparent areas and adjacent interior glazing sheet patterns registering at least partially with the transparent areas of the exterior glazing sheet patterns.

The sealed glazed unit consists of two or three glazing sheets that define one or two glazing cavities that are preferably filled with argon gas for improved energy efficiency. Also to provide for improved energy efficiency, a low-e coating is preferably incorporated on at least one surface of the glazing cavities.

Strip patterns may preferably define window frames surrounding the transparent area, and around the frames surface area patterns may be designed to simulate almost any kind of surface finish, and in particular the appearance of traditional building materials such as bricks, stone, granite, marble and clay tile, and the like, including mortar joints and the like.

The surface area patterns can be provided in any suitable manner, e.g.: by use of ceramic frit materials that can be deposited on glass by virtue of heat transfer decals in roll or strip form; by printing patterns on flexible plastic film material laminated onto a cavity surface of one or more of the glazing sheets; or by printing patterns on flexible plastic film material from which surface area patterns can be transferred to a plastic coating on one or more of the glazing sheets by virtue of a dye sublimation process.

The opaque strip elements can similarly be provided in many ways, e.g.: by use of ceramic frit material; by printing on flexible plastic film material; by use of strips of flexible plastic sheet material adhered to glass by virtue of a pre-applied pressure sensitive adhesive on strips; or by use of shaped form members adhered to exterior surfaces of the glazing sheets. In the latter case, the shaped form members can be vacuum formed from plastic sheet material or may comprise hollow linear profiles. The shaped form members can be adhered to the glazing sheets by virtue of double sided adhesive foam tape or by other manners.

However provided, the opaque strip elements are preferably designed to have one side that is of a relatively light shade and an opposite side that is of relatively dark shade, and are attached to the glazing sheets in an orientation such that the side of the relatively dark shade is adjacent to the glazing cavity. This, in conjunction with relatively close spacing of the glazing sheets, creates an illusion that the opaque strip elements constitute solid window frame elements extending through the building panel.

Building panels as described herein are useful in many applications. One notable example is their potential for use in providing a curtain wall structure in multi-story buildings. In this application, a panel will be sized to span a distance between structural floors of a building. The glazing sheets will preferably be of heat strengthened or tempered glass. Also, it is advantageous for the exterior glass sheet of the building panel to be slightly enlarged, i.e. to have perimeter edges that extend slightly beyond edges of the other glazing sheet or sheets, thereby providing peripheral support flanges. Rigid channels can be adhered to the support flanges by virtue of silicone sealant, and these channels can suitably be fibreglass.

BRIEF DESCRIPTION OF THE DRAWINGS

The following is a description by way of example of certain embodiments of the present invention, reference being made in the accompanying drawings, in which.

DETAILED DESCRIPTION OF THE PREFERRED EMBODIMENTS

Figure 1:
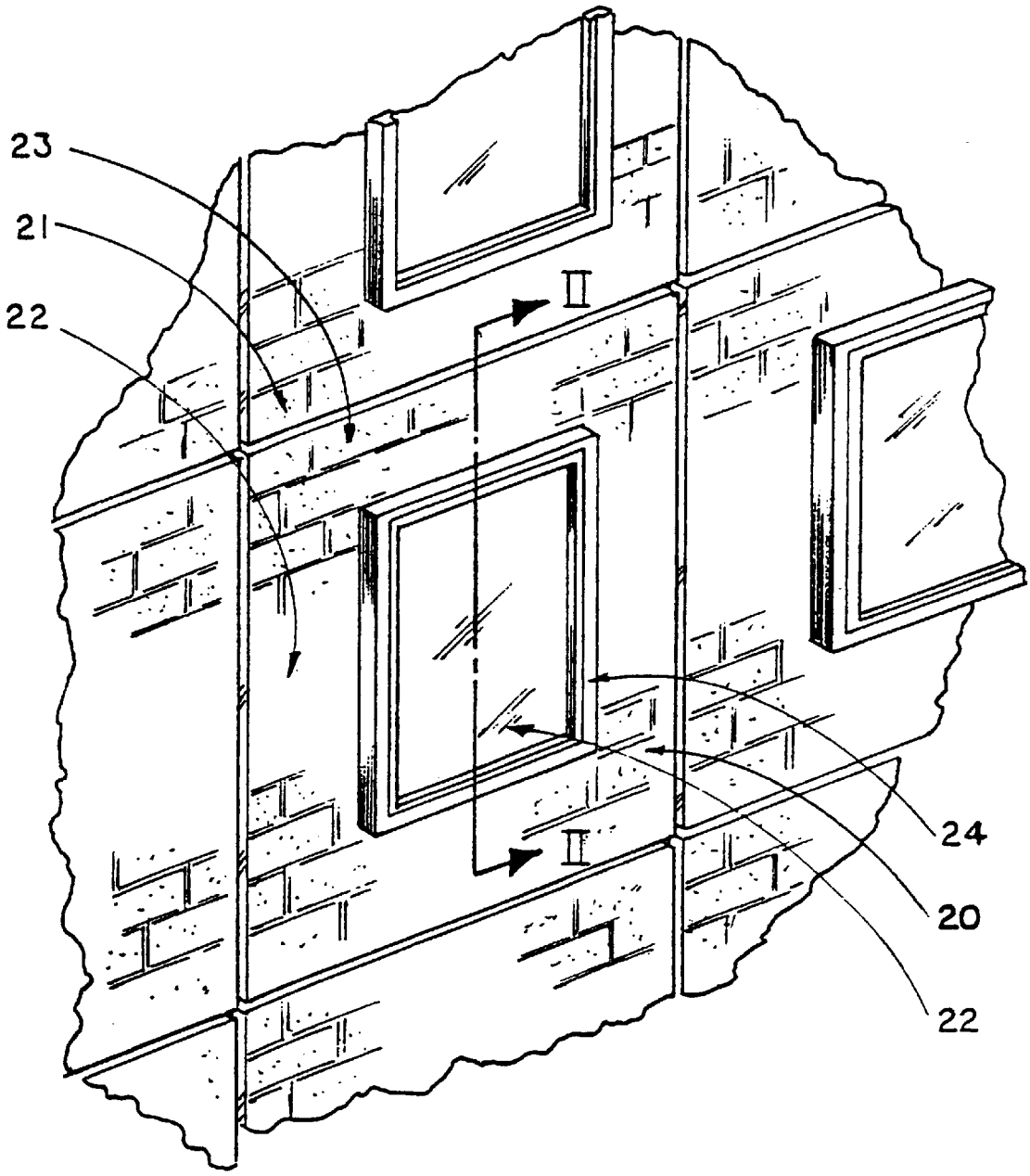
FIG. 1 is a fragmentary exterior perspective view showing an architectural building panel that simulates the appearance of a window incorporated within a brick wall.

FIG. 1 is a fragmentary exterior perspective view of an architectural building panel 20 that simulates the appearance of a window incorporated within a simulated brick-clad building wall.

The panel 20 consists of a triple-glazed sealed unit 21 that incorporates a transparent area 22 and surrounding exterior surface patterned area 23 (area pattern) that simulates the appearance of clay bricks. Located between the transparent area 22 and the exterior surface patterned area 23 are opaque strip elements 24 that simulate the appearance of window frame profiles.

Figure 2:
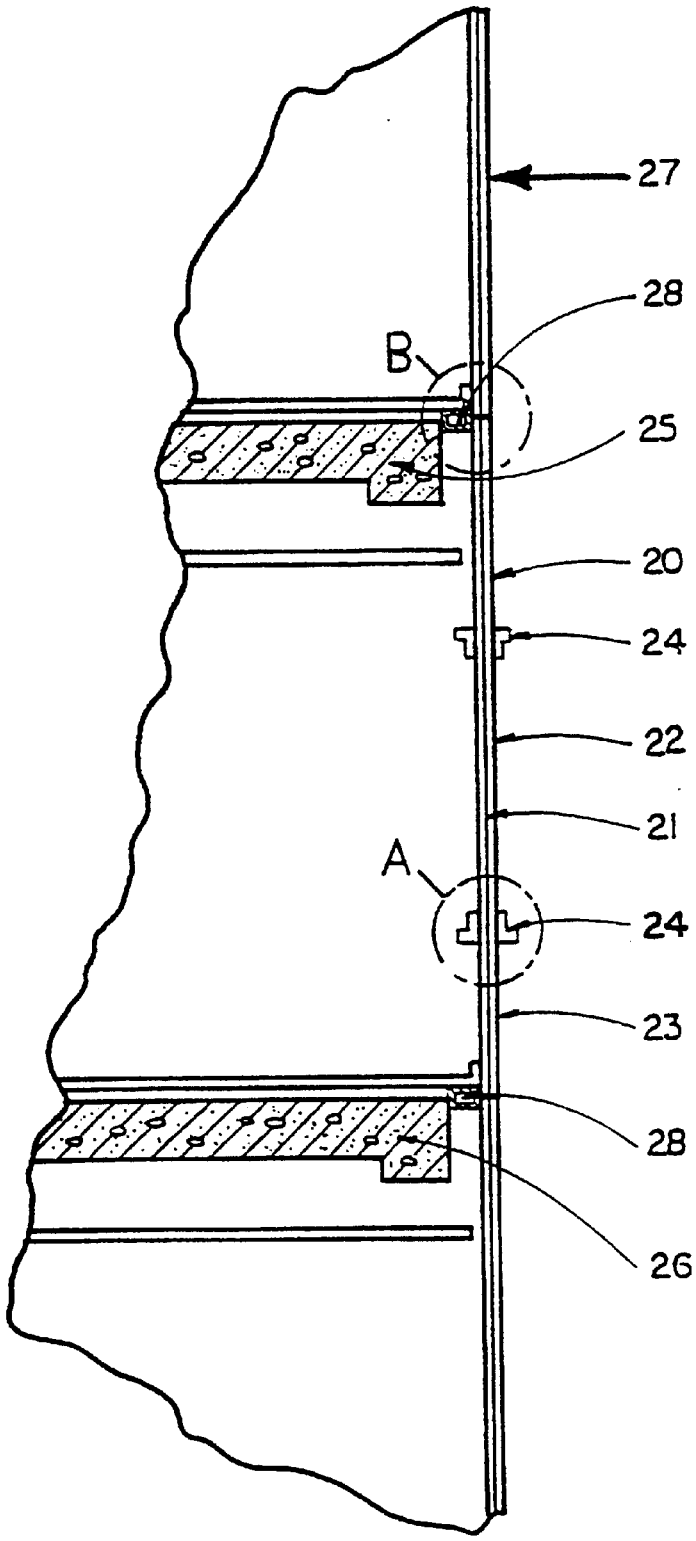
FIG. 2 is a vertical cross-sectional view of the architectural building panel taken generally on the line II—II in FIG. 1 showing the panel extending between structural floors of a high-rise building.

FIG. 2 shows a vertical cross section of the architectural building panel 20 taken generally on the line II—II in FIG. 1 showing the panel 20 extending between structural floors 25 and 26 of a high-rise building 27. The panel 20 incorporates a triple-glazed sealed unit 21 that is structurally adhered to a metal grid framing system 28 that is mechanically connected to the building's main structural floors 25 and 26.

Figure 3:
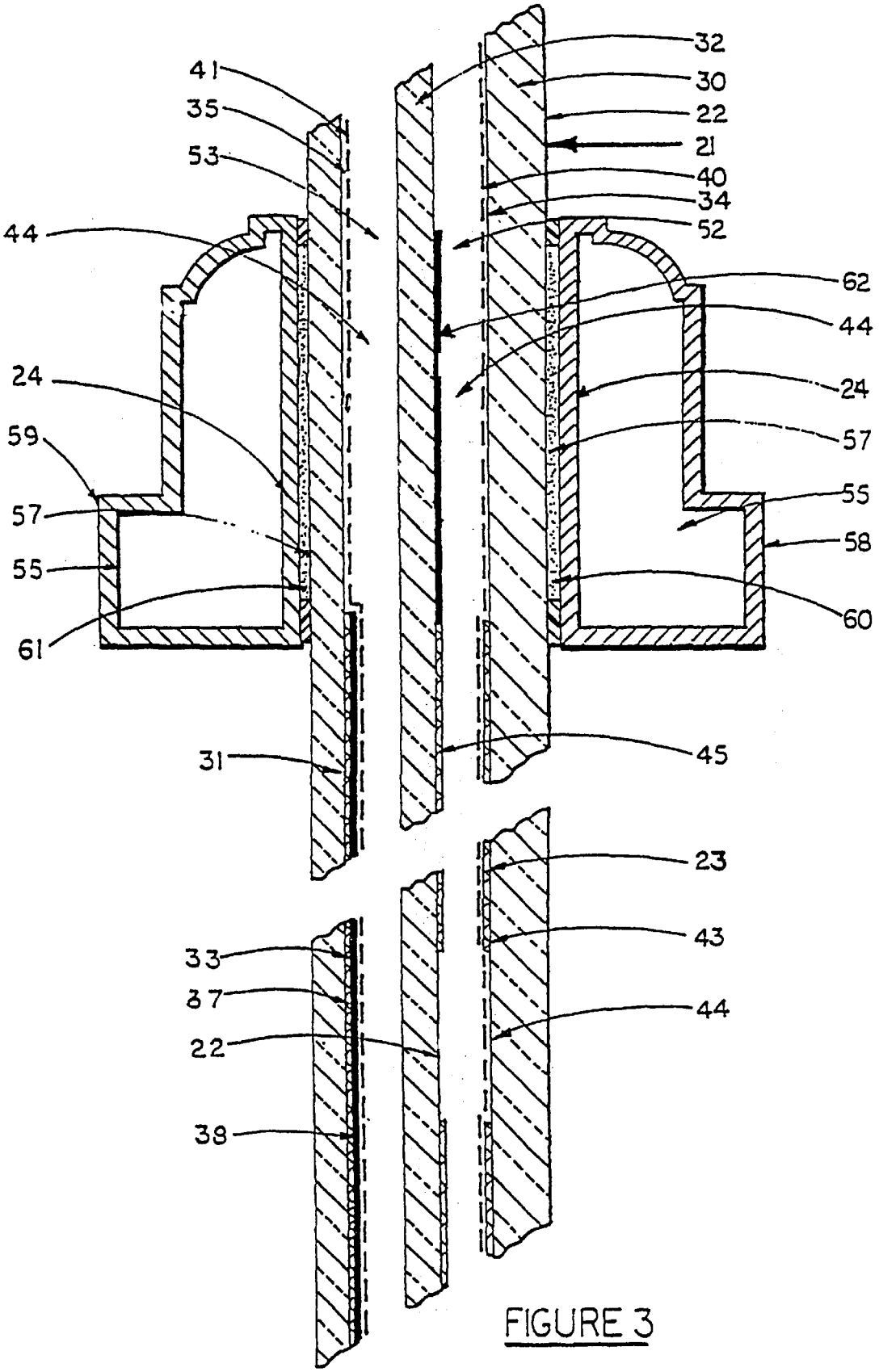
FIG. 3 is an enlarged vertical cross-sectional detail of the region indicated by the circle A in FIG. 2 showing a simulated window/wall junction.

FIG. 3 shows an enlarged vertical cross section detail of the region indicated by the circle A in FIG. 2. The triple-glazed sealed unit 21 consists of an exterior glass glazing sheet 30, an interior glass glazing sheet 31 and a center glass glazing sheet 32. Surface patterned areas 23 and 33 are applied to cavity surfaces 34 and 35 of the exterior and interior glazing sheets 30 and 31, respectively.

Surface patterned area 33 (area pattern) consists of an opaque decorative surface coating 37 which is typically a light shade that is generally backed by a second surface coating 38 that is typically a dark shade.

Surface patterned area 23 consists of rectangular opaque areas 43 on the cavity surface 34. Between the rectangular opaque areas 43, there are transparent margin areas 44 such that when the combined patterns are viewed at an angle, a three dimensional illusion is created of a brick wall with traditional mortar joints.

The rectangular opaque areas 43 located on the exterior glazing sheet 30 can be textured with transparent voids within the surface pattern, and an optional surface coating 45 can be applied to the center glazing sheet 32. The optional surface coating 45 on the center glazing sheet 32 can be a different color such that when viewed from the exterior, three patterns in combination create the illusion of a textured surface.

Although a brick wall surface is shown in FIG. 3, it can be appreciated by those skilled-in-the-art that the visual appearance of various other traditional building materials can be simulated including stone, granite, marble and clay tiles.

The surface coating 45 and surface patterned areas 23, 33 are fabricated from ceramic frit material that is fused to the glass glazing sheets 30, 31 and 32 at high temperatures. After ceramic coatings have been applied and the glass glazing sheets 30, 31 and 32 have been tempered, sputtered low-e coatings 40 and 41 can be applied to the cavity surfaces 34 and 35. Although transparent, the low-e coatings 40 and 41 reduce radiative heat loss across glazing cavities 52 and 53. To further reduce conductive heat loss, the glazing cavities 52 and 53 can be filled with argon gas. A width of the glazing cavities is typically about 12.5 mm; however, if a decorative window design incorporates narrow muntin bars or other similar details, the width can be reduced to ⅜" or less.

A width of the triple-glazed unit 21 is typically less than 2 inches. However, because of various energy efficient features such as low-e coatings and argon gas, and also because there is reduced perimeter heat loss through window frames and spandral panels, such a narrow width unit provides comparable insulating performance relative to a conventional curtain wall assembly where a width or thickness of a wall of the assembly is typically at least 6 inches. This potential reduced wall thickness is important because under most building zoning regulations, the allowable size of a building is determined based on exterior building dimensions while rentable space is determined based on interior building dimensions. Specifically, when a slim wall cladding system is retrofitted to an existing building, rentable space can be increased resulting in increased revenue to the building owner.

Typically, the exterior glass glazing sheet 30 is thicker than the interior and center glass glazing sheets 31 and 32, and this helps ensure that the exterior glass glazing sheet remains flat and does not bow inwards or outwards due to pressure changes within the glazed sealed unit 21.

Opaque strip elements 24 are applied at boundary areas 44 between transparent glazing areas 22 and the surface patterned areas 23 and 33. The opaque strips 24 are generally in register with each other. Generally, outwardly facing sides 58 and 59 of the opaque strip elements 24 are of a light shade while inwardly facing sides 60 and 61 of the opaque strip elements are typically of a dark shade with black being the preferred color.

The opaque strip elements 24 are of a sufficient width such that when viewed at an oblique angle, a visual illusion is created of a solid framing member that spans between the glass glazing sheets 31 and 30. Depending on a width of the opaque strip elements 24, an optional flat strip 62 can be applied to the center glass glazing sheet 32. The opaque strip elements 24 can be made from various materials and as shown in FIG. 3, one option is for the opaque strip elements to be made from hollow linear profiles 55 that are adhered to outwardly facing sides of the glass glazing sheets 30 and 31 with two-sided adhesive foam tapes 57. The hollow linear profiles 55 are made from aluminum, but various other materials can be used including: fibreglass, PVC plastic and wood. Typically, the two-sided adhesive foam tape is made from polyethylene foam and acrylic is the preferred material for a pressure sensitive adhesive.

Figure 4:
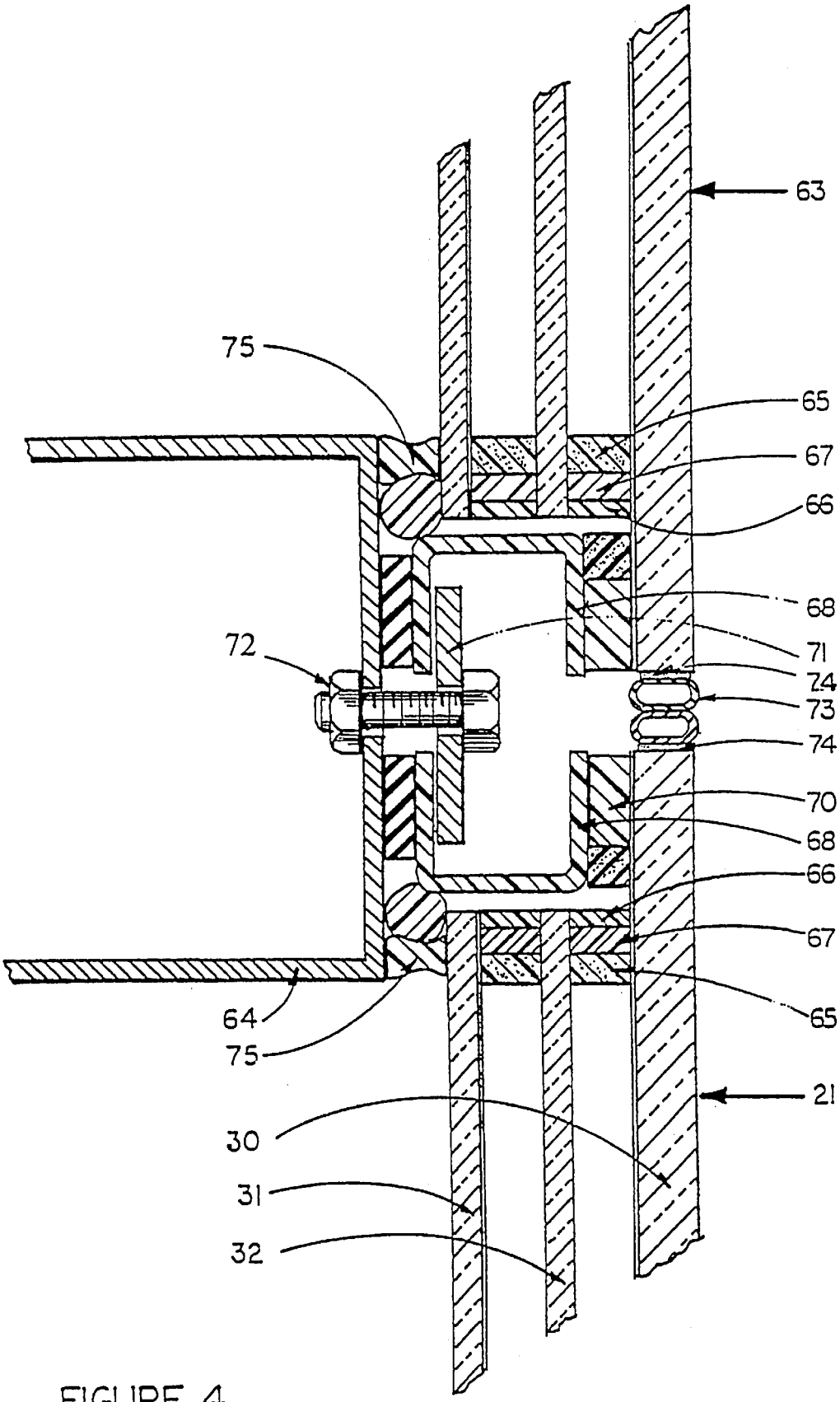
FIG. 4 is an enlarged vertical cross-sectional detail of the region indicated by the circle B in FIG. 2 and showing a jointing system between two building panels and an interface with a metal grid structure.

FIG. 4 is an enlarged vertical cross section detail of the region indicated by the circle B in FIG. 2. There are two adjacent triple-glazed sealed units 21 and 63 that are both structurally connected to a metal support frame 64. The triple-glazed sealed units 21 and 63 are sealed at their perimeter edges using a tri-seal combination consisting of an inner flexible desiccant-filled foam spacer 65 that is structurally adhered to the glass glazing sheets 30, 31 and 32; an outer layer of structural thermosetting silicone sealant 66, and a layer of hot melt thermoplastic butyl 67 or polyisobutylene sealant sandwiched between the foam spacer 65 and silicone sealant 66. A key advantage of this tri-seal design is that as the glass glazing sheets 30, 31 and 32 flex back and forth, a butyl moisture/barrier seal remains firmly held against the glass glazing sheets 30, 31 and 32, and this ensures outstanding edge seal durability.

The exterior glass glazing sheet 30 extends about one inch beyond the edge seal, thus creating a perimeter flange 69. A fibreglass channel 68 is structurally adhered to perimeter flange 69 using structural silicone sealant 70. The fibreglass channel 68 is mechanically connected to the support frame 64 by virtue of a swivel toggle connector 71 and bolt 72. An outer rain screen joint between the two triple-glazed sealed units 21 and 63 is sealed by hollow silicone rubber extrusions 73 adhered to perimeter edges 74 of respective glass glazing sheets 30. Two inner air seal joints between the metal support frame 64 and the triple-glazed sealed units 21 and 63 are sealed by silicone sealant 75.

Figure 5:
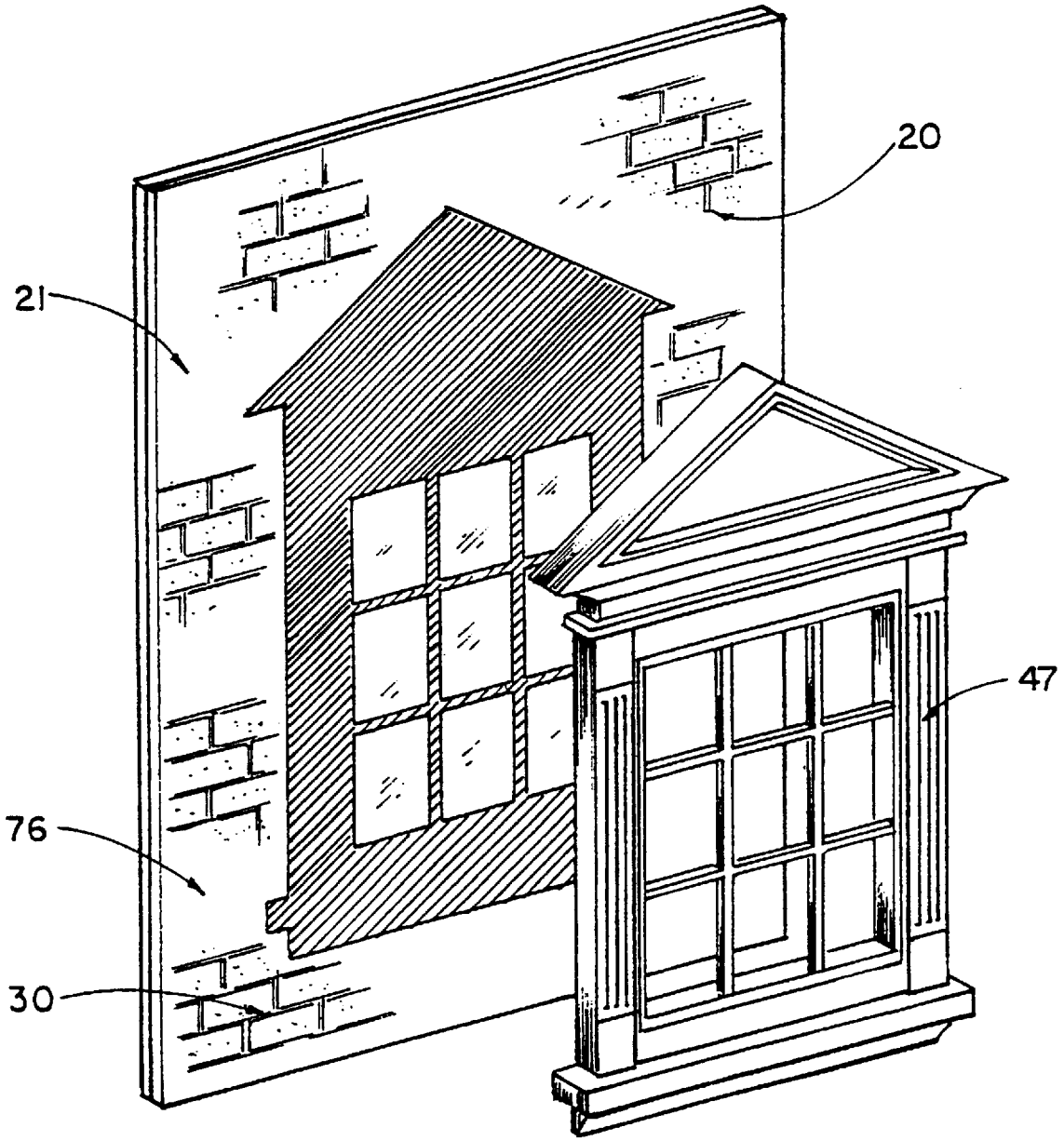
FIG. 5 is a partially exploded perspective view of an architectural building panel that simulates the appearance of a traditional heritage window incorporated within a brick wall.

FIG. 5 is a partially exploded perspective view of an architectural building panel 20 that simulates the appearance of a traditional heritage window incorporated within a simulated brick wall. Building panel 21 consists of a double glazed unit 76 with a window attachment 47 that is adhered to the double-glazed unit with double sided pressure sensitive adhesive sheet foam. To provide for additional structural support, silicone sealant can also be used as a structural seal between the window attachment 47 and exterior glazing sheet 30. The window attachment 47 is made from plastic sheet material such as polyethylene that is vacuum formed, and which is coated with a durable material such as a fluoro elastomer coating. For improved rigidity, the window attachment 47 can be foam filled with a light rigid foam material such as polyurethane.

Figure 6:
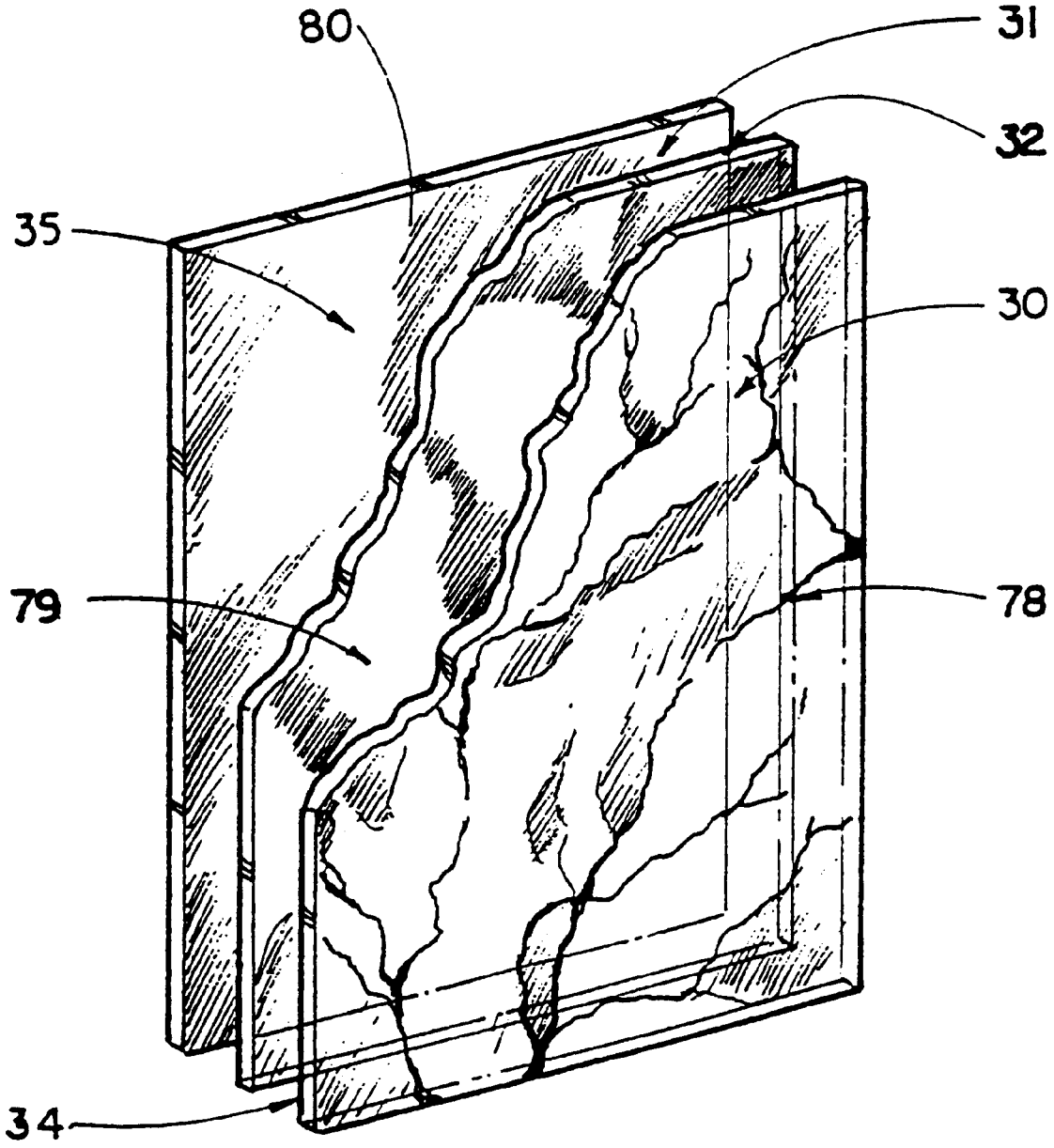
FIG. 6 is a fragmentary perspective view of a triple-glazed unit that simulates the appearance of marble, wherein there are different patterns on different surfaces of the triple-glazed unit.

FIG. 6 is a fragmentary perspective view of a triple-glazed unit that simulates the appearance of polished marble stone. Exterior glazing sheet 30 incorporates a series of decorative patterns 78 that are located on glazing cavity face 34 and which simulate in part the appearance of specific colored features of a particular marble stone.

Center glazing sheet 32 incorporates a second and different series of decorative patterns 79 that also simulate the appearance of other features of the marble stone. Third interior glazing sheet 31 can also incorporate a third and different series of decorative patterns 80 that are located on glazing cavity surface 35, and that also simulate the appearance of additional colored features of a particular marble stone. Particularly when viewed at a distance, the three overlapping decorative patterns 78, 79 and 80 collectively simulate a rich textured appearance of polished marble.

Although a marble surface pattern is given as an example in FIG. 6, it can be appreciated by those skilled-in-the-art that other decorative textured surface finishes can also be simulated with different surface patterns being applied to multiple glazing sheets.

Ceramic decorative patterns shown in FIGS. 1–6 can be produced in various ways. One option is to directly apply the ceramic patterns to the glazing sheets using conventional silk screen printing processes. However, because of limitations of silk screen printing processes, there is a need for relatively high volume printing runs and as a result, building panel designs generally have to be standardized.

A second option is to produce the ceramic decorative patterns using a single large scale decal that is applied using a heat transfer process. Again, because of limitations of decal printing processes which are presently available, building panel designs generally have to be standardized. However, in the future these limitations may be overcome with development of ink jet printers suitable for ceramic inks.

A third option is to assemble the decorative patterns from a series of decal strips that are separately applied to a glazing sheet while the glazing sheet is in a stationary position. A width of the decal strips can vary and can be as wide as typical wallpaper rolls. The decal strips can be produced by various printing processes, and one preferred option is to use a rotor gravure process.

Figure 7I:
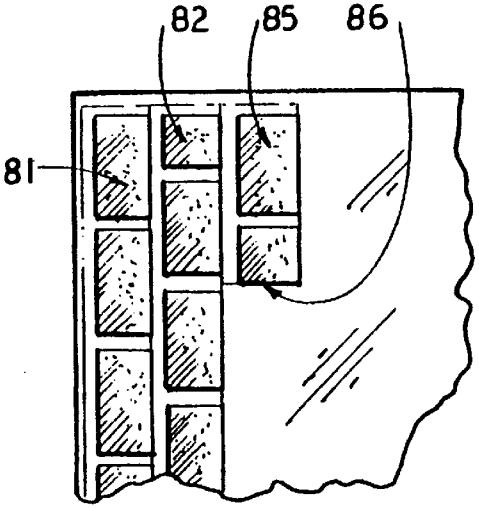
FIGS. 7(*i*)–7(*v*) are series of fragmentary plan views of production steps for producing ceramic decorative patterns on a glass sheet.
Figure 7I:
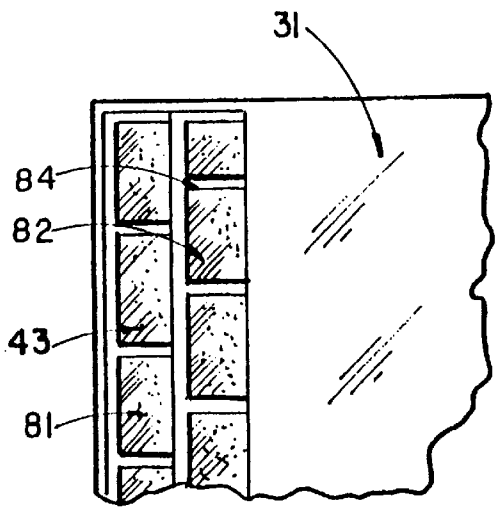
Figure 7I:
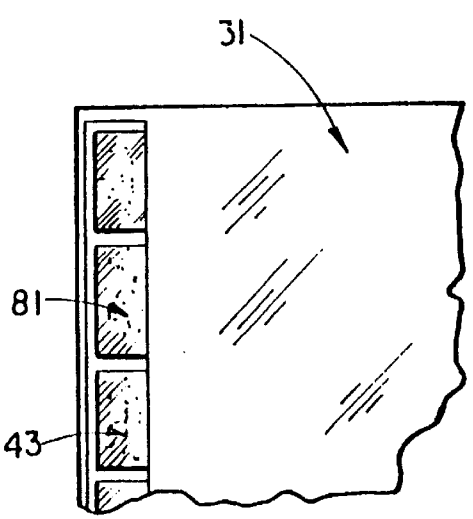
Figure 7V:
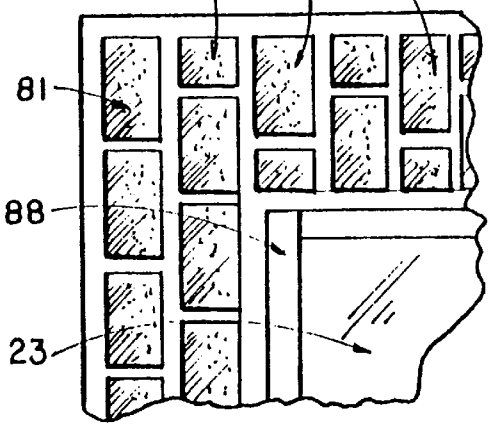
Figure 7:
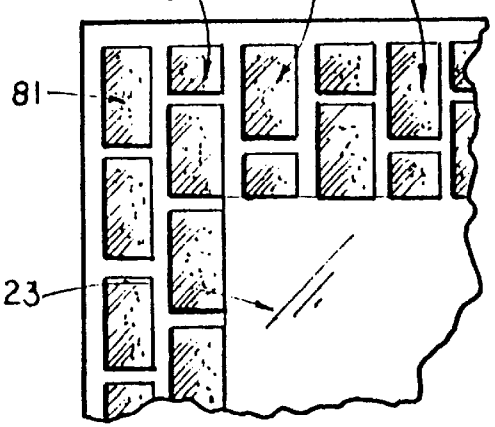

FIGS. 7(*i*)–7(*v*) show a series of fragmentary plan views of production steps for producing custom decorative patterns of ceramic frit material on a glass sheet 31 that is in a stationary position.

FIG. 7(*i*) shows application of a single decal strip 81 incorporating opaque rectangular patterns 43, wherein the strip 81 is applied using a heated roller that moves horizontally or vertically across the glass sheet 31.

FIG. 7(*ii*) shows application of a second decal strip 82 incorporating opaque rectangular patterns 43, that is located about a half inch away from the strip 81, and wherein transparent margins 84 between rectangular patterns of the strip 82 are located at about a center line of the rectangular patterns 43 on the decal strip 81.

FIG. 7(*iii*) shows application of a third decal strip 85, wherein the strip is cut off at a mid point 86 of a second rectangular pattern.

FIG. 7 (*iv*) shows application of additional decal strips 87 that are cut off to form a transparent area 23. Because the opaque rectangular patterns are separated by a transparent margin, there is no need to very accurately match up the patterns at decal edges, and large customized panel designs can be easily and efficiently manufactured. A width of the decal strips can vary and can be as wide as a typical wallpaper roll, with wider strips incorporating a series of rectangular patterns side by side.

FIG. 7(*v*) shows application of an optional perimeter strip 88 around a perimeter of the transparent area 23. The perimeter strip 88 is of ceramic frit material and can feature one side that is a light shade and another side that is a dark shade.

Figure 8:
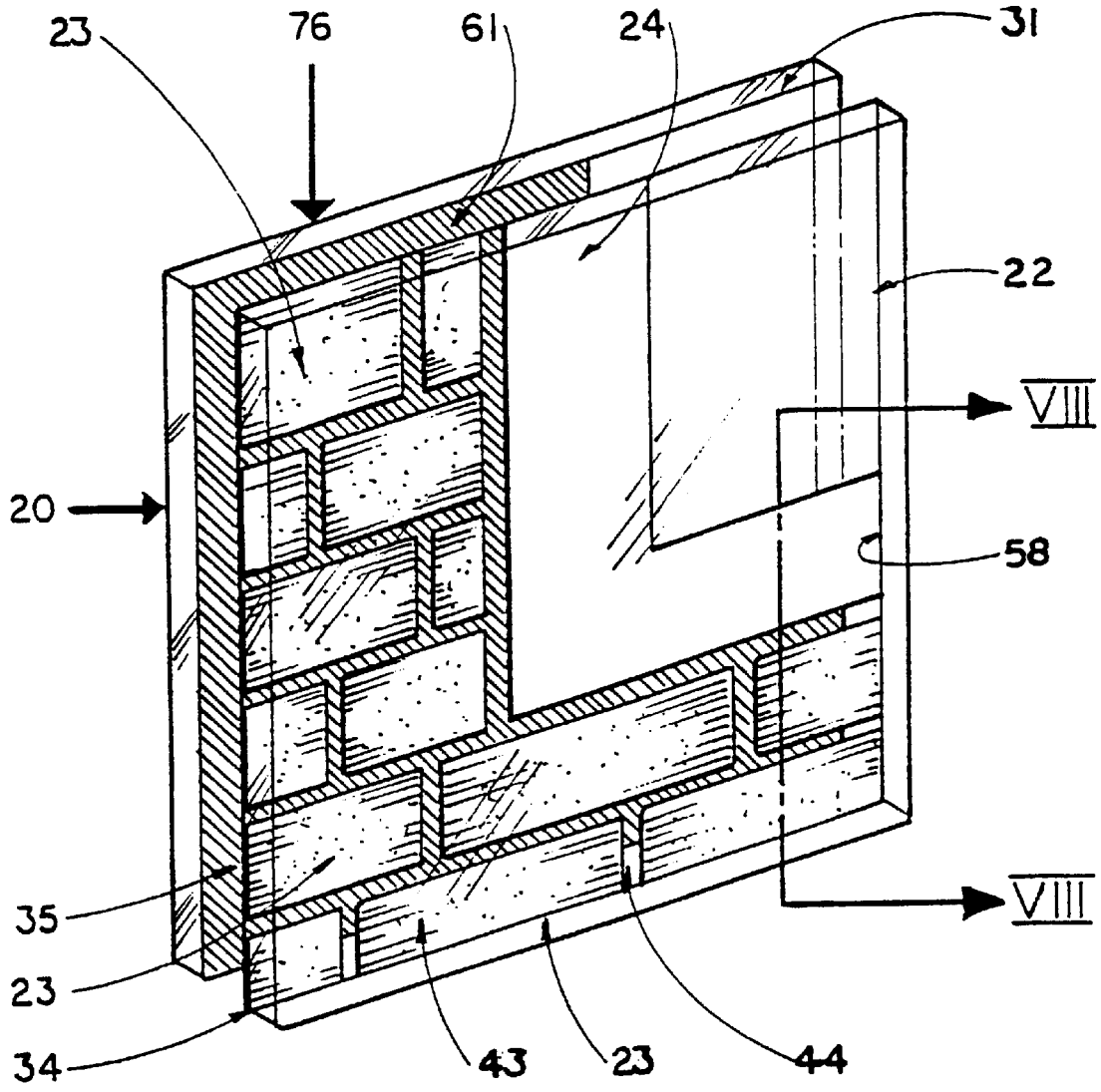
FIG. 8 is a fragmentary perspective view of a double-glazed building panel that graphically simulates the appearance of a window incorporated within a brick wall

FIG. 8 is a perspective view of an architectural building panel 20 that simulates the appearance of a window incorporated within a simulated brick wall. The building panel 20 consists of a double-glazed unit 76 with a transparent area 22, exterior and interior surface area patterns 23 and 33, and opaque strip elements 24 that divide the transparent area 22 from the exterior and interior surface area patterns 23 and 33.

The exterior surface area pattern 23 consists of rectangular opaque areas 43, and between the rectangular opaque areas there are transparent margin areas 44. The interior surface area pattern 33 typically consists of light and dark shade patterns 61, wherein the light shade patterns face a building interior (not shown) and the dark shade patterns 61 face a glazing cavity. When viewed from the exterior, the two surface area patterns 23 and 33 create a three dimensional illusion of a brick wall with traditional mortar joints. At boundary areas between transparent areas 22 and surface area patterns 23 and 33, there are opaque strip patterns 24. Two opaque strip elements 24 are generally in register with each other. Typically, outwardly facing sides of the opaque strip elements 24 are of a light shade while inwardly facing sides of the strip elements are a dark shade with black being the preferred color.

Figure 9:
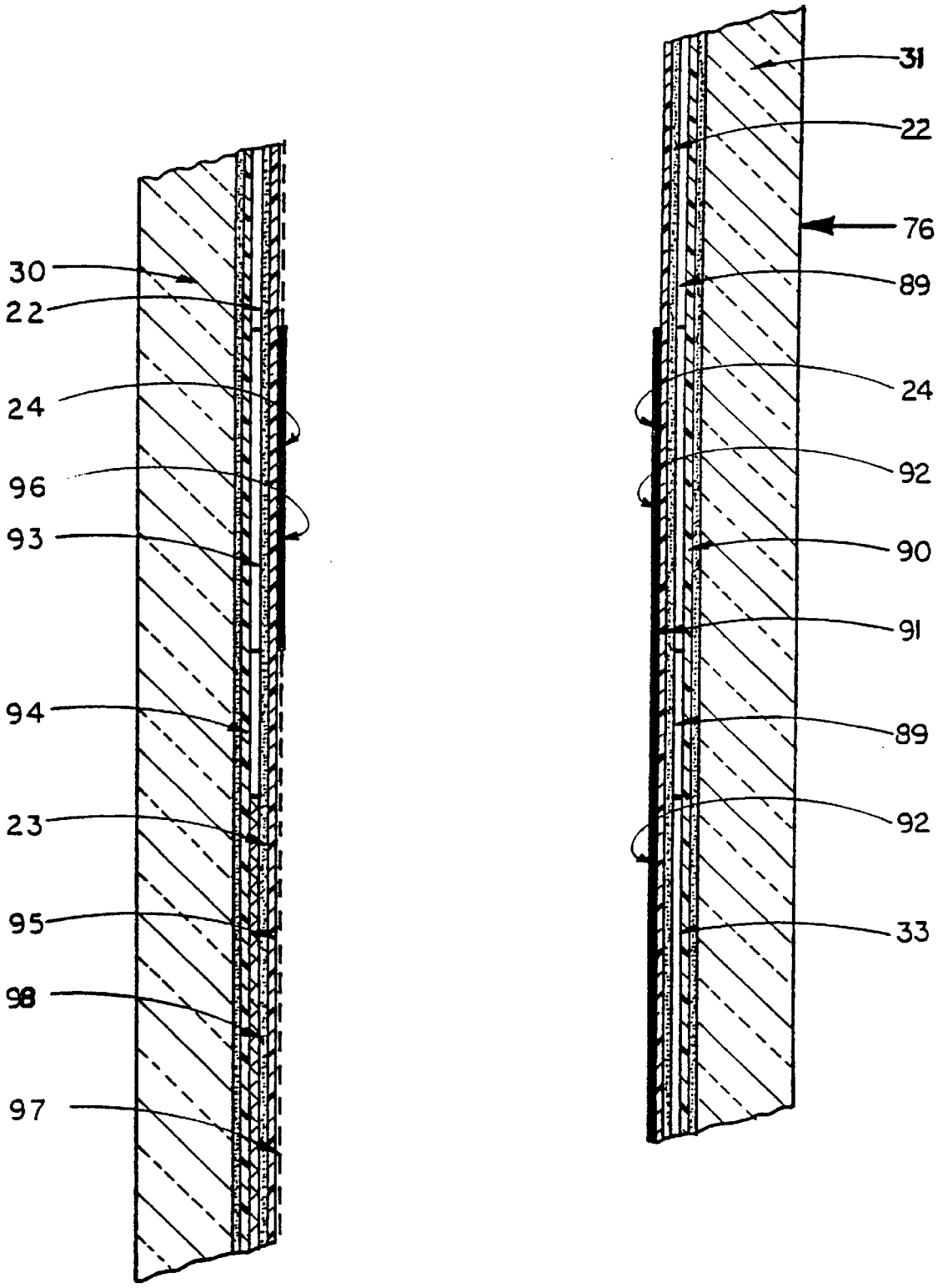
FIG. 9 is an enlarged cross sectional detail of the double-glazed building panel illustrated in FIG. 8 as seen on the line VIII—VIII.

FIG. 9 is an enlarged cross sectional detail of the double-glazed unit illustrated in FIG. 8 as seen on the line VIII—VIII. For interior glazing sheet 31, various opaque and surface pattern areas are produced by first printing light shade patterns 89 onto a transparent adhesive plastic film sheet 90. A second transparent adhesive film sheet 91 is laminated onto the first film sheet 90 with dark shade patterns 92 being printed where appropriate in register with the light shade patterns 89, such that a double layer plastic film sheet is provided. This double layer plastic film sheet is then laminated onto a cavity face of the interior glazing sheet 31.

For exterior glazing sheet 30, various light shade surface patterns 93 are first printed on a transparent adhesive film sheet 94. A second film sheet 95 is laminated onto the first film sheet 94 with dark shade patterns 96 being printed where appropriate in register with the light shade patterns 93 such that a double layer plastic film sheet 98 is provided. This double layer plastic film sheet material 98 is then laminated onto the rigid exterior glazing sheet 30. A pre-applied low-e coating 97 may be incorporated on a cavity surface of the second film sheet 95.

The preferred material for the plastic film sheets is polyethylene terephthalate (PET), and the preferred material for the adhesive is an optically clear, pressure sensitive acrylic adhesive. Various printed patterns are typically produced using pigmented ink and large format ink jet printers.

To prevent color fading, the plastic film sheet adjacent to the exterior glazing sheet 30 incorporates UV-absorbing material. As a further measure to prevent color fading, a glazing cavity can be filled with argon gas and a perimeter edge-seal can incorporate oxygen-scavenging material to remove all oxygen from the glazing cavity.

Instead of laminating printed plastic film sheets onto glazing cavity surfaces, decorative opaque and patterned areas can be produced through various other methods. For example, decorative patterns can be printed on a flexible plastic film that is suspended within the glazing cavity. Alternatively, one or more of the glazing sheets can incorporate a plastic polyester coating on a cavity glazing face. Decorative patterns can also be printed on paper and then transferred to the glazing sheet through a dye sublimation process.

A further alternative option is to create decorative patterns from strips or rolls of plastic sheet material that are adhered to the glazing sheets with pre-applied pressure sensitive adhesive. These strips can be fabricated from plastic sheet material that features a light shade on one side and a dark shade on another side.

Figure 10:
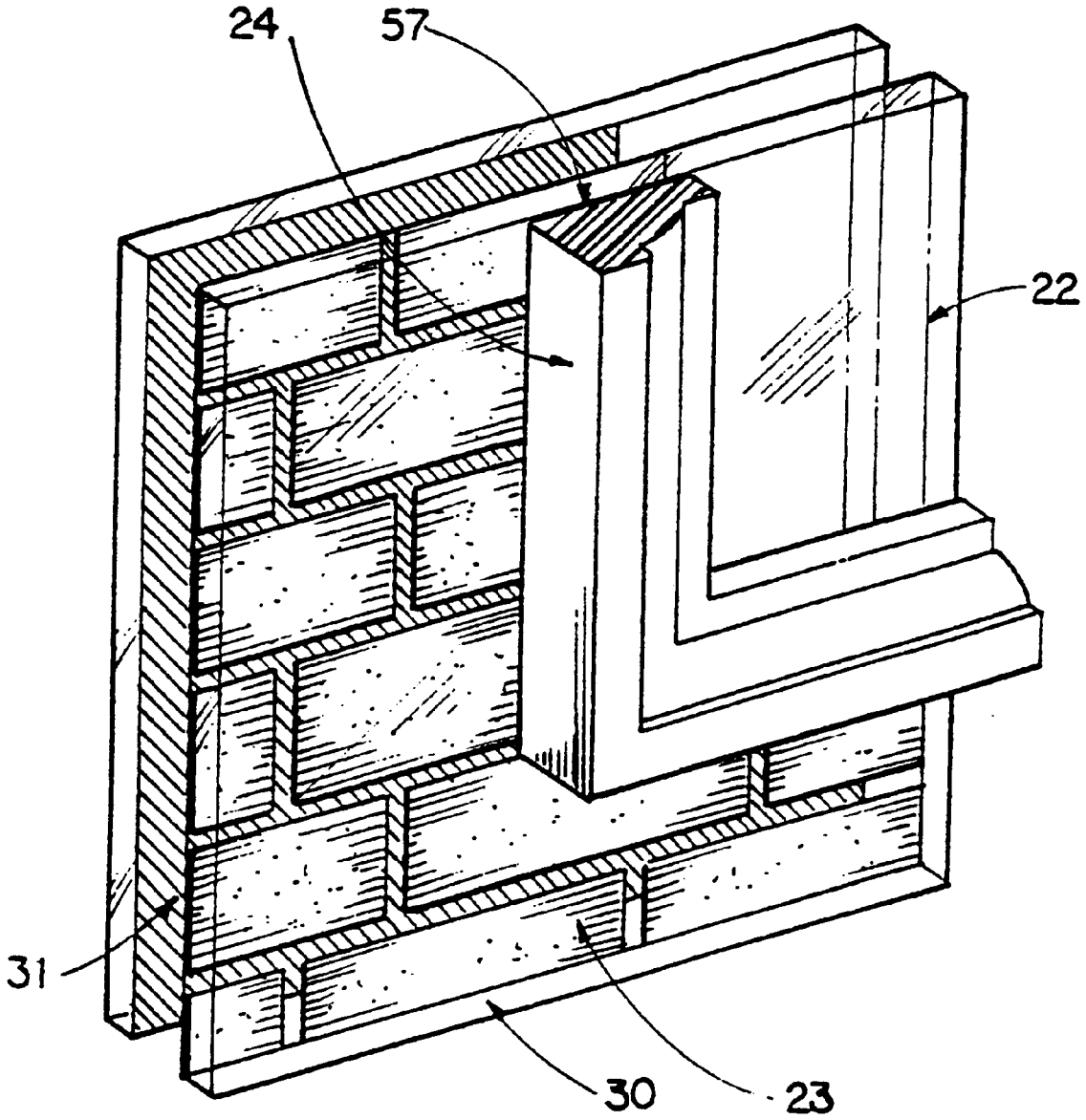
FIG. 10 is a fragmentary perspective view of a double-glazed building panel, with attached linear hollow profiles, that simulates the appearance of a window within a brick wall.

FIG. 10 is a perspective view of an architectural building panel that is similar in construction to the building panel shown in FIG. 8 except that opaque strip elements 24 that surround transparent area 22 are hollow linear profiles that are adhered to glazing sheets 30 and 31 with pressure sensitive adhesive.

What is claimed is:

1. An architectural building panel comprising:

at least two spaced apart parallel glazing sheets each including (i) peripheral edges, and (ii) a transparent area, with said transparent area of one of said at least two glazing sheets being aligned with said transparent area of each other of said at least two glazing sheets to define a window region, wherein said at least two glazing sheets include a first glazing sheet and a second glazing sheet, with a first area pattern being on said first glazing sheet and a second area pattern being on said second glazing sheet;

a peripheral seal extending between the peripheral edges of adjacent ones of said at least two glazing sheets to define a sealed unit having an insulating cavity between surfaces of said adjacent ones of said at least two glazing sheets;

a first opaque strip element on said first glazing sheet, said first opaque strip element delimiting a first respective said transparent area; and a second opaque strip element on said second glazing sheet, said second opaque strip element delimiting a second respective said transparent area, wherein said first opaque strip element is in an aligned registration with said second opaque strip element, with said first and second opaque strip elements each being of a width, parallel to the surface on which it is located, that is sufficient to create a visual illusion of solid members within a respective said insulating cavity, and wherein said first area pattern is located on a portion of said first glazing sheet that extends between said peripheral edges of said first glazing sheet and said first respective transparent area, and said second area pattern is located on a portion of said second glazing sheet that extends between said peripheral edges of said second glazing sheet and said second respective transparent area, such that said first and second area patterns cooperate with one another to define a decorative pattern that simulates an appearance of traditional building materials between said peripheral edges of said first glazing sheet and said first opaque strip element whereby a combination of said first and second respective transparent areas, said first and second opaque strip elements, and said first and second surface area patterns simulate an appearance of a framed window incorporated within a building wall.

2. The architectural building panel according to claim 1, wherein said first glazing sheet comprises an exterior glazing sheet, a glazing sheet adjacent to said exterior glazing sheet has thereon a third area pattern, and said first area pattern comprises a first pattern that delimits transparent areas, and said third area pattern comprises a second pattern that registers with said transparent areas delimited by said first pattern.

3. The architectural building panel according to claim 2, wherein said first pattern comprises a series of opaque figures, and said second area pattern comprises said second pattern as an opaque surface area pattern, such that in combination said series of opaque figures and said opaque surface area pattern simulate an appearance of building materials with traditional mortar joints, with these materials being selected from brick, stone, granite, marble and clay tile.

4. The architectural building panel according to claim 2, wherein said second glazing sheet is to be adjacent a building interior, and said second area pattern comprises a surface area pattern being of a relatively light shade on a side that is to face the building interior and of a relatively dark shade that is to face away from the building interior.

5. The architectural building panel according to claim 1, wherein said at least two glazing sheets comprise one of (i) two glazing sheets such that said peripheral seal extending between the peripheral edges of said two glazing sheets defines a double-glazed sealed unit, and (ii) three glazing sheets such that said peripheral seal extending between the peripheral edges of said three glazing sheets defines a triple-glazed sealed unit.

6. The architectural building panel according to claim 1, further comprising a low-e coating on a surface of at least one of said at least two glazing sheets that define a respective said cavity, wherein said respective said cavity is filled with argon gas.

7. The architectural building panel according to claim 1, wherein said at least two glazing sheets each comprise heat strengthened or tempered glass, and said sealed unit is sized so as to extend between structural floors of a building.

8. The architectural building panel according to claim 1, wherein said first glazing sheet comprises an exterior glazing sheet, the peripheral edges of which are located beyond the peripheral edges of each other of said at least two glazing sheets such that support flanges are defined by portions of said first glazing sheet that extend beyond the peripheral edges of said each other of said at least two glazing sheets, and further comprising rigid channels adhered to said support flanges via a silicone sealant.

9. The architectural building panel according to claim 8, wherein said rigid channels comprise fiberglass channels.

10. The architectural building panel according to claim 1, wherein said first and second area patterns each comprise ceramic frit material.

11. The architectural building panel according to claim 1, wherein said first area pattern comprises a pattern printed onto a flexible plastic film material that is laminated onto a surface of said first glazing sheet defining a respective said cavity, and said second area pattern comprises a pattern printed onto a flexible plastic film material that is laminated onto a surface of said second glazing sheet defining a respective said cavity.

12. The architectural building panel according to claim 1, wherein said first glazing sheet includes a first plastic coating, and said first area pattern comprises a pattern transferred to said first plastic coating from a flexible plastic film via dye sublimation, and said second glazing sheet includes a second plastic coating, and said second area pattern comprises a pattern transferred to said second plastic coating from a flexible plastic film via dye sublimation.

13. The architectural building panel according to claim 1, wherein said first and second opaque strip elements each have one side that is of a relatively light shade and an opposite side that is of a relatively dark shade, with said side that is of a relatively light shade facing away from said sealed unit, and said side that is of a relatively dark shade facing toward a respective said cavity.

14. The architectural building panel according to claim 1, wherein said first and second opaque strip elements comprise ceramic frit opaque strip elements.

15. The architectural building panel according to claim 1, wherein said first and second opaque strip elements comprise strips of flexible plastic sheet material that are adhered to said first and second glazing sheets, respectively, via a pressure sensitive adhesive that is pre-applied to said strips.

16. The architectural building panel according to claim 1, wherein said first and second opaque strip elements comprise shaped members adhered to said first and second glazing sheets, respectively.

17. The architectural building panel according to claim 16, wherein said shaped members comprise members vacuum shaped from plastic sheet material.

18. The architectural building panel according to claim 16, wherein said shaped members comprise members each having a hollow linear profile.

19. The architectural building panel according to claim 16, wherein said shaped members are attached to said first and second glazing sheets, respectively, via a double sided adhesive foam tape.

20. The architectural building panel according to claim 1, wherein said first area pattern comprises ceramic frit material that is deposited onto a surface of said first glazing sheet from heat transfer decals in a strip or roll form while said first glazing sheet is in a stationary position, and said second area pattern comprises ceramic frit material that is deposited onto a surface of said second glazing sheet from heat transfer decals in a strip or roll form while said second glazing sheet is in a stationary position.

* * * * *